United States Patent [19]

Schivley, Jr. et al.

[11] Patent Number: 4,892,160

[45] Date of Patent: Jan. 9, 1990

[54] DRILL PIPE TRANSFER ARM FOR ANGLE DRILLING

[75] Inventors: George P. Schivley, Jr., Richardson; Calvin J. Moore, Jr., Dallas, both of Tex.

[73] Assignee: Ingersoll-Rand Company, Woodcliff Lake, N.J.

[21] Appl. No.: 366,298

[22] Filed: Jun. 13, 1989

Related U.S. Application Data

[63] Continuation of Ser. No. 199,718, May 27, 1988, abandoned.

[51] Int. Cl.[4] ..... E21B 19/00

[52] U.S. Cl. ..... 175/85; 175/52; 166/85; 414/22.53; 414/22.66

[58] Field of Search ..... 175/52, 61, 85, 220; 166/77.5, 85; 414/22, 22.66, 22.68

[56] References Cited

U.S. PATENT DOCUMENTS

| | | | |
|---|---|---|---|
| 3,506,075 | 4/1970 | Attebo | 175/52 |
| 3,533,516 | 10/1970 | Guier | 414/22 |
| 3,913,754 | 10/1975 | Swartz et al. | 414/22 |
| 4,586,572 | 5/1986 | Myers et al. | 414/22 |

FOREIGN PATENT DOCUMENTS

| | | | |
|---|---|---|---|
| 0130676 | 4/1978 | German Democratic Rep. | 175/52 |
| 1257160 | 9/1986 | U.S.S.R. | 175/52 |
| 0898390 | 6/1962 | United Kingdom | 175/85 |

*Primary Examiner*—Jerome W. Massie, IV
*Assistant Examiner*—Terry L. Melius
*Attorney, Agent, or Firm*—J. R. Bell; W. C. Vliet; D. W. Tibbott

[57] ABSTRACT

A drill pipe transfer arm supports the bottom portion of a drill pipe and positions it in relationship to the drill string to permit angle drilling with a tilted drill tower. The transfer arm is uniquely suited to circular carousels and features a drill pipe conforming saddle which permits close-quarter operation with a packed carousel.

7 Claims, 3 Drawing Sheets

DRILL PIPE TRANSFER ARM FOR ANGLE DRILLING

This application is a file wrapper continuation of application Ser. No. 199,718, filed May 27, 1988 now abandoned.

BACKGROUND OF THE INVENTION

A limitation arises with drill rings having on-board drill pipe storage devices (otherwise known as carousels) when it is required to drill a hole at some orientation other than vertical. In a typical drill rig, the carousel is located within the tower structure and during angle drilling, wherein tower itself is tilted at an angle to accomplish the drilling by lining up with the drill string, a problem of supporting and aligning the lower end of the drill pipe has occurred.

The limitation referred to above occurs when taking drill pipe out of the carousel to add the drill string already in the hole. While the top of the drill pipe is attached to the spindle of a typical rotary head the lower end of the drill pipe will still be lying in the carousel due to the angular orientation of the tower and the effect of gravity. This condition is shown in phantom in FIG. 1. To resolve this situation some means must be provided to lift the lower end of the drill pipe and bring it in line with the drill string.

SUMMARY OF THE INVENTION

The present invention overcomes the limitations set forth above by providing a new and improved means of supporting drill pipe in angle drilling apparatus and assisting its transfer from the carousel to the drill string. This is accomplished in a drill pipe transfer arm for angle drilling comprising a lever arm having pipe support means at one end and a pivot means at its other end; and means for rotating said lever arm about said pivot means to traverse said pipe support means from a position where said drill pipe is stored in a means for storage to a position in alignment with a drill string.

DESCRIPTION OF THE PREFERRED EMBODIMENT

Figure 1:
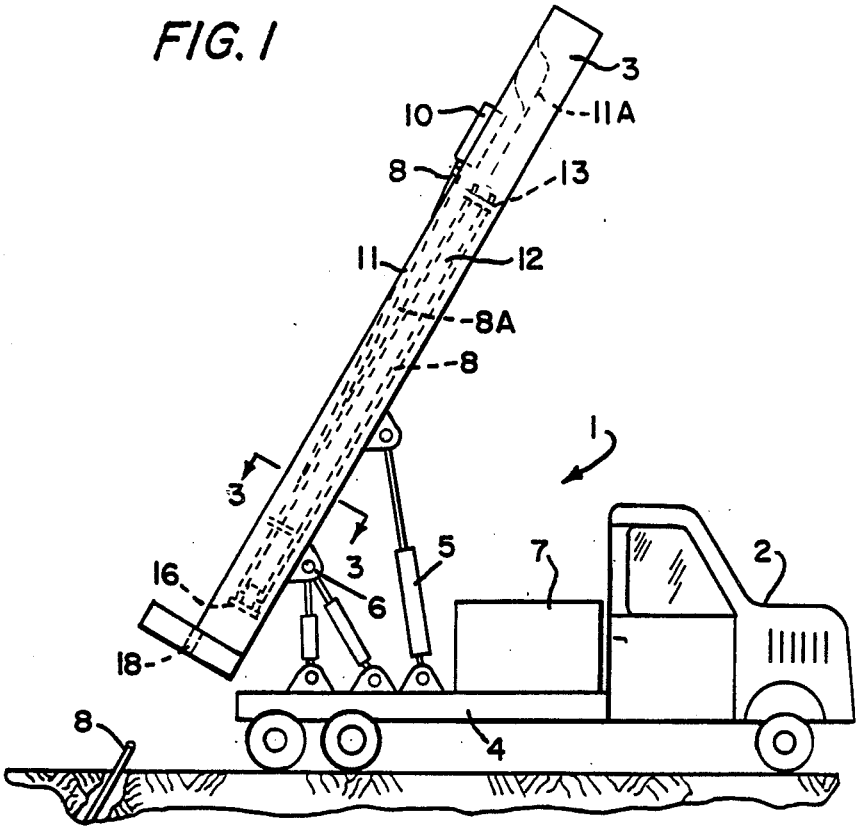
FIG. 1 shows an elevation view of a typical drill rig in an angle drilling position.

Referring now to FIG. 1 a typical drill rig capable of angle drilling is generally designated by reference numeral 1. Such drill rigs typically comprise a propulsion means such as a truck 2 or crawler (not shown), a tower 3, supported on a drill rig base 4, and having means 5 such as a hydraulic or pneumatic cylinder to elevate the tower about a pivot structure 6. A power pack-7 is provided to supply hydraulic fluid to the lifting cylinders and rotary head 10 shown mounted on the tower. A drill pipe 8 is shown connected to the rotary head 10.

Figure 4:
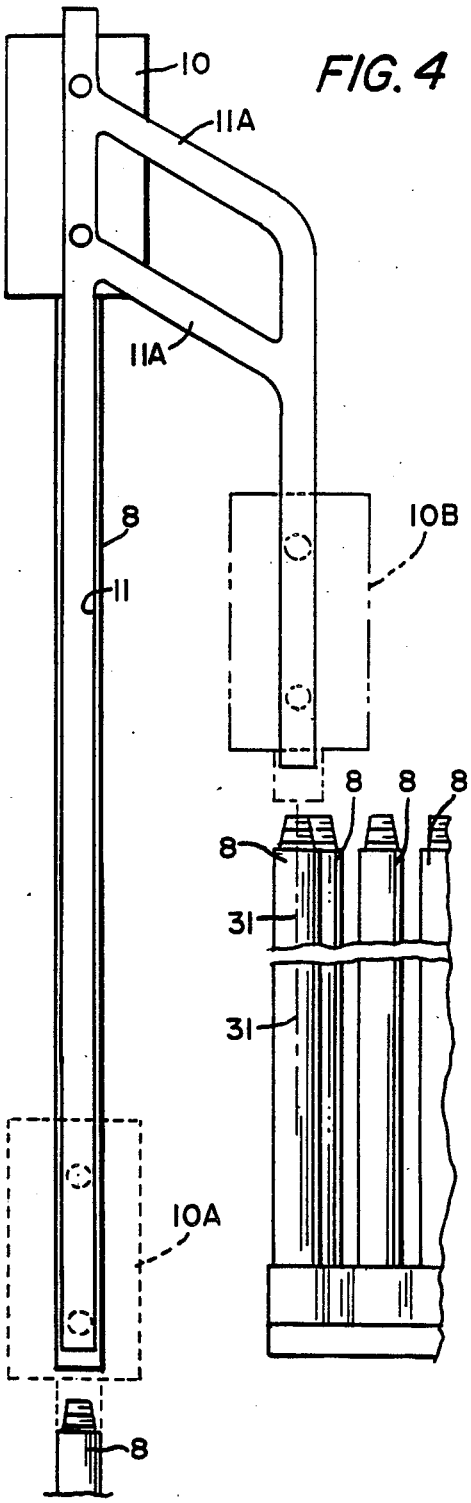
FIG. 4 is a schematic elevation showing alignment of the rotary head in three positions relative to the drill string.

Referring to FIG. 4, shown supported on the tower is a rotary head 10 shown in two alternate positions 10A and 10B. The rotary head is capable of traversing the tower on a guide track 11 from a position near the top of the tower (position 10) as shown in FIG. 4 to a position near the bottom of the tower (position 10B). In addition, the rotary head is capable of traversing to the interior of the tower (position 10B) by means of parallel transfer tracks 11A which permits the rotary head to align with an internal drill pipe carousel 12 whereby the rotary head may be connected to one of the drill pipes in the carousel aligned with the centerline of the rotary head when in the interior position as shown by reference numeral 10B in phantom. Transfer from the track 11 to track 11A is accomplished by means of switch gates which are known in the industry and are not shown.

Figure 2:
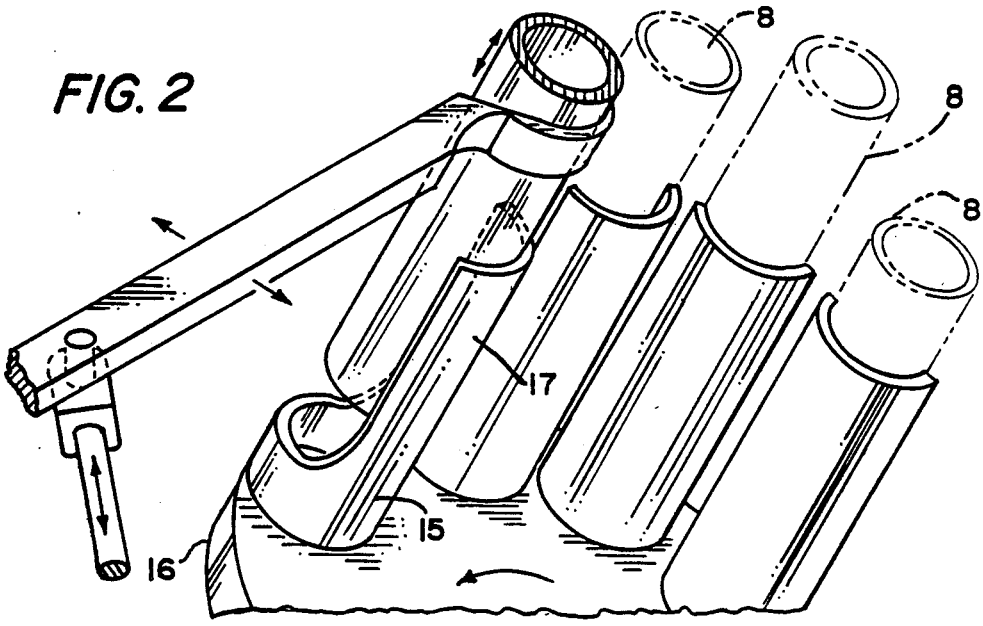
FIG. 2 shows a perspective view of the transfer arm at the carousel lower table showing details of the arm construction and the special rod cups utilized with the present invention.
Figure 3:
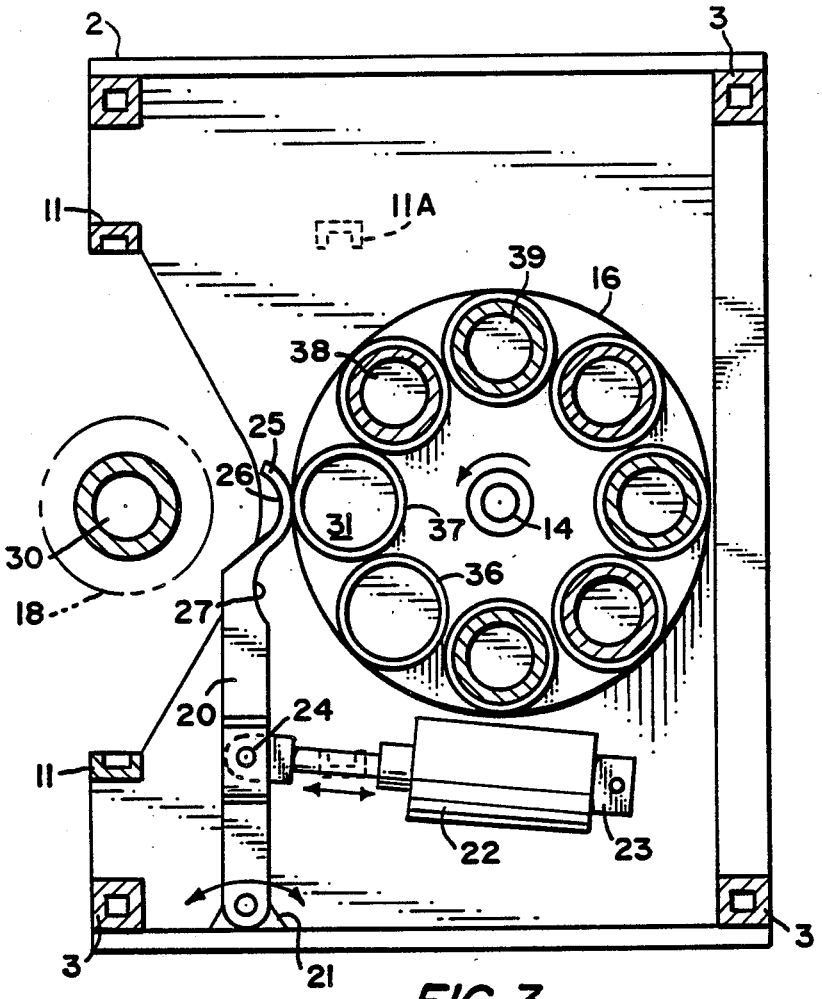
FIG. 3 shows a plan view of the carousel transfer arm and drill string in relationship to the tower structure.

In a typical carousel the drill pipe 8 is captured at the top end in radially disposed slots in a circular plate 13 and are retained in the radially disposed slots by means of an encircling ring (not shown) which captures the drill pipe in all but the one position where transfer is made—typically the front-most drill pipe (37 shown in FIG. 3) which aligns with the rotary head in the interior position. The lower end of the drill pipe is supported on the carousel which is synchronized top and bottom by a centralized tube 14 as best seen in FIG. 3, the drill pipe being conventionally supported in cups 15 which securely hold the tube in position as the carousel rotates. Referring to FIG. 2 the carousel rotates in the counterclockwise direction as shown in relationship to the transfer arm of the present invention, to unload the carousel. However, it should be understood in this description that clockwise rotation is utilized to load the carousel with the transfer arm located as shown.

For purposes of the present invention support cups 15 are shown mounted to the lower table 16 of the carousel. The support cups 15 are typically short cylindrical sections having essentially one-half of the periphery extended for a considerable distance to form a scooplike projection 17 on the cup to provide additional support as the pipe is withdrawn from the lower portion of the cup when in the angle drilling position.

According to prior art, once the rotary head is connected to the upper end of the drill pipe and the drill pipe withdrawn from the lower end of the support cup, it is still not in line with the drill string. The driller must then manually hoist the lower end of the drill pipe and support it until it could be positioned so it might be connected to the upper end of the drill string, whereby drilling could commence.

According to the present invention a drill rod transfer arm is provided, as best seen in FIG. 3. The transfer arm comprises a support arm 20, attached to the tower by means of a tower mounting pivot 21. The arm 20 is moved to alternative positions by means of a hydraulic cylinder 22 connected to the tower at cylinder pivot 23 and to the transfer arm 20 at pivot 24.

The mounting pivot 21 and the pivot 24 for the hydraulic or pneumatic cylinder are chosen in such a manner as to allow the support end 25 of the transfer arm 20 to describe an arc between the centerline of the drill string 30 and the centerline 31 of the drill pipe in the carousel radially oriented in the position closest to the drill string. The support end 25 of the transfer arm is shaped so as to form a semicircular support 26 for the drill pipe in the transfer from the carousel to the centerline of the drill string. In addition, the reverse side of the support arm 20 is provided with a concave relief notch 27 which permits the transfer arm to fit between the pipe being transferred and the first pipe to be stowed. As shown in FIG. 3, counterclockwise rotation is utilized to unload the carousel. Clockwise rotation would be utilized to load the carousel.

The general orientation of the transfer arm relative to the carousel and the drill string is shown in FIG. 3. Also shown is the orientation of the carousel and the drill string relative to the tower 3, and the rotary head side track 11. Although not at the elevation shown by cross section 3—3 on FIG. 1, FIG. 3 shows the position of the upper guide tracks 11A relative to the centerline of the drill pipe which would be at reference numeral 31.

In operation, the drill pipe 8 would be stationed in the carousel with each of the support cups 15 loaded with a length of drill pipe 8. As viewed in FIG. 3 the transfer arm 20 would be in its arcuate position all the way to the right resting on the first loaded pipe at position 36 and in a position to the interior of the first unloaded pipe at position 37.

During transfer of the drill rig to the drill site typically the carousel would be full of drill pipe and one piece of drill pipe would be connected to the rotary head and supported at its lower end by partly projecting through the centralizer 18, in the tower bottom. The centralizer is a bearing which stabilizes the drill pipe, at the tower bottom, during the drilling process.

Upon arrival at the drill site, the sequence of operation would then be to position the drill rig at the location of the hole to be drilled and tilt the tower to the required tilted position to drill the angle of drilling required. Drilling would then be started by lowering the rotary head and driving the drill pipe attached to the rotary head through the centralizer into the ground. The drill pipe would be provided with a drill bit at its lower end to produce the necessary cutting action to permit the drill pipe to progress into the ground.

Upon reaching the lower terminus the rotary drill head would be reversed thereby unscrewing it from the drill pipe in the drilled hole. The rotary head would then be raised in the drill track 11 to the top of the tower where it would be transferred to transfer track 11A by means of well-known gate means. Thereafter it would again be lowered on transfer track 11A to the point where it would contact the drill pipe at position 37 (as shown in FIG. 3). The rotary head would then be rotated to connect it to the drill pipe at position 37. The rotary head would then be raised in the transfer track 11A to a position on drill track 11. The hydraulic or pneumatic cylinder 22 would be extended by introduction of pressure fluid from a suitable power source 7 thereby raising the bottom end of the drill pipe at position 37 to alignment with the hole to be drilled at centerline 30.

The rotary drill would then be turned on for rotation and the rotary head 10 would be progressed downward in the guide track 11 to produce the start of the drilled hole. Upon reaching the lower terminus 10A the rotary head would be reversed thereby unscrewing it from the drill pipe in the drilled hole. The rotary head would then be raised along the guide track 11 to the upper terminus where it would be transferred on to the transfer track 11A by means of well known gate means, lowered to the point 10B where it would contact the drill pipe at position 38 which would now have been rotated to the position formally occupied by position 37 in a counterclockwise fashion.

The transfer arm, having previously been retracted after drilling started to its innermost position is now behind drill pipe 38. The rotary head is then rotated to couple the rotary head with the drill pipe in position 38 and the drill pipe is thereafter lifted out of the carousel cup by means of the rotary head and transferred in the matter previously described to the position in alignment with the drill string, the rotary head being thereafter again lowered and rotated to effect coupling with the drill pipe in the hole. Thereafter rotation and lowering of the rotary head effect continued drilling of the drill hole.

Upon completion of the stroke, by the rotary head reaching the lower terminus, the process is repeated to pick up the drill pipe in position 39 and the sequence is repeated again and again as often as necessary to effect the depth of drill hole required.

Upon completion of the drilled hole the entire sequence is reversed placing the individual drill pipe in the carousel and rotating the carousel in the clockwise manner, in this case, until the last drill pipe is inserted in the carousel. When the last drill pipe is replaced, the transfer arm is captured between the first removed drill pipe and the last removed drill pipe which fill the carousel.

It should be understood that the design of the outer transfer arm with the cylindrical pipe segment forming the semicircular support for the drill pipe and the convex cutout 27 on the reverse portion of the transfer arm are important features of the invention in that they permit the transfer arm to remain in the carousel behind the last removed drill pipe with the first removed drill pipe remaining in its position without interference from the transfer arm. This permits the carousel to handle its full component of drill pipe.

As previously mentioned the elongated support cups 15, having the radially inward half of the support cup extended to form a scoop like device for support of the drill pipe removes some of the strain of support from the transfer arm as the tube is removed from the cup. The location of the pivot 21 and the pivot 24 along with the length of the transfer arm 20 should be chosen to have the semicircular support end of the transfer arm traverse between the centerline of the drill pipe to be positioned and the centerline of the drill string.

Having described our invention in terms of a preferred embodiment it is recognized that variations may be made therein without departing from the invention as set forth in the claims.

We claim:

1. A transfer arm for controlling and positioning the lower end of a drill pipe upon removal from a stored position in a circular carousel to an aligned position with a drill string comprising:

a lever arm interspaced between said carousel and a drill string centerline having pipe support means at one end and a pivot means at its other end;

means for rotating said lever arm about said pivot means to traverse said pipe support means from a position where said drill pipe is stored in said carousel to a position in alignment with said drill string centerline;

said pipe support means having a cylindrical pipe segment in an orientation such that it is substantially open toward said drill string and substantially closed toward said carousel; and said lever arm including a recessed means spaced apart from and radially inward and opposite opening to said support means to accommodate close quarter drill storage in loading and unloading said carousel.

2. The transfer arm as defined in claim 1, wherein said pivot means is attached to a drill tower.

3. The transfer arm as defined in claim 1, wherein said means for rotating said lever arm comprises a pressure fluid cylinder having one end attached to said lever arm by means of a pivot point and its other end attached to a drill tower.

4. A transfer arm for controlling and positioning the lower end of a drill pipe upon removal from a stored position in a circular carousel to an aligned position with a drill string comprising:

a lever arm interspaced between said carousel and a drill string centerline having pipe support means at one end and a pivot means at its other end;

means for rotating said lever arm about said pivot means to traverse said pipe support means from a position where said drill pipe is stored in said carousel to a position in alignment with said drill string centerline; and said lever arm including a recessed means spaced apart from and radially inward and opposite opening to said support means to accommodate close quarter drill storage in loading and unloading said carousel.

5. The transfer arm as defined in claim 4, wherein said pipe support means includes a cylindrical pipe segment in an orientation such that it is substantially open toward said drill string and substantially closed toward said carousel.

6. The transfer arm as defined in claim 4, wherein said pivot means is attached to a drill tower.

7. The transfer arm as defined in claim 4, wherein said means for rotating said lever arm comprises a pressure fluid cylinder having one end attached to said lever arm by means of a pivot point and its other end attached to a drill tower.

* * * * *